US005797147A

United States Patent [19]

Young et al.

[11] Patent Number: 5,797,147

[45] Date of Patent: Aug. 25, 1998

[54] SPILL-RESISTENT URINAL

[76] Inventors: Michael J. Young, 680 N. Lake Shore Dr. #424; James A. Young, 680 N. Lake Shore Dr. #621, both of Chicago, Ill. 60611; Jack Bankier, 6151 Gross Point Rd., Niles, Ill. 60714

[21] Appl. No.: 738,665

[22] Filed: Oct. 25, 1996

[51] Int. Cl.[6] ..... A47K 11/12

[52] U.S. Cl. ..... 4/144.1; 4/144.3; 604/350; 137/846; 137/515

[58] Field of Search ..... 4/144.1, 144.2, 4/144.3, 144.4, 259, 274, 282, 283; 128/760, 761, 763, 764; 604/323, 329, 349, 350; 141/344, 345; 220/373; 137/515, 515.7, 846

[56] References Cited

U.S. PATENT DOCUMENTS

| | | | |
|---|---|---|---|
| D. 370,975 | 6/1996 | Mohr | 4/144.1 |
| 622,631 | 4/1899 | Orbeton . | |
| 698,419 | 4/1902 | Taylor . | |
| 2,745,111 | 5/1956 | Podmorski | 4/144.1 |
| 3,163,869 | 1/1965 | Johnson et al. . | |
| 3,405,714 | 10/1968 | Moss | 604/350 |
| 3,526,227 | 9/1970 | Appelbaum | 604/350 |
| 3,928,875 | 12/1975 | Persson . | |
| 3,967,645 | 7/1976 | Gregory | 604/323 |
| 4,059,124 | 11/1977 | Hill | 4/144.2 |
| 4,091,476 | 5/1978 | DeBurgh . | |
| 4,164,795 | 8/1979 | Johnson . | |
| 4,309,779 | 1/1982 | Knight . | |
| 4,665,571 | 5/1987 | Muccione . | |
| 5,309,578 | 5/1994 | Temple, Sr. | 4/144.1 |
| 5,569,225 | 10/1996 | Fleury | 604/323 |
| 5,599,332 | 2/1997 | Cashel | 604/323 |
| 5,618,277 | 4/1997 | Goulter | 604/350 |

FOREIGN PATENT DOCUMENTS

| | | | |
|---|---|---|---|
| 250768 | 7/1948 | Switzerland | 4/144.1 |

*Primary Examiner*—Charles R. Eloshway

*Attorney, Agent, or Firm*—Marshall, O'Toole, Gerstein, Murray & Borun

[57] ABSTRACT

A urinal for men who cannot use a toilet or are otherwise incapacitated has a canister with a removable spout. A manual seal in the spout can be manipulated between open and closed positions by a trigger on the exterior of the spout, and locked into the open position by a releasable locking arm. A vertically-arranged opening in a dome seal attached to the spout helps prevent spillage in the event the urinal is knocked onto its side when the manual seal is locked open. The spout is attached to the canister by a releasable collar, and thus can be easily separated for cleaning.

9 Claims, 6 Drawing Sheets

FIG. 5
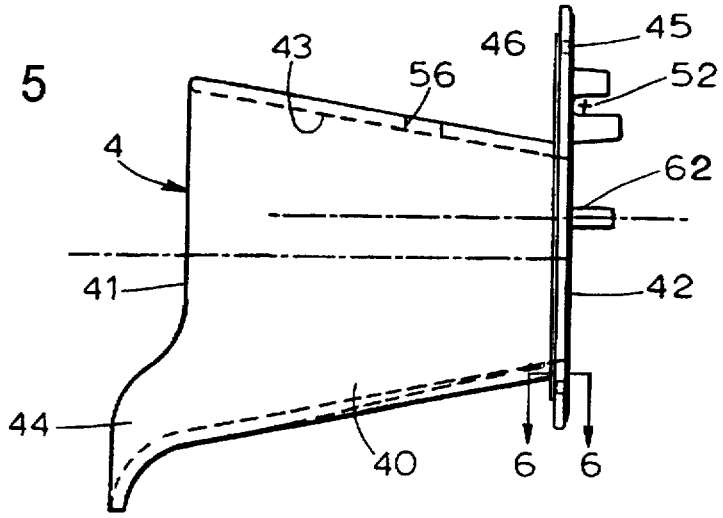
FIG. 7
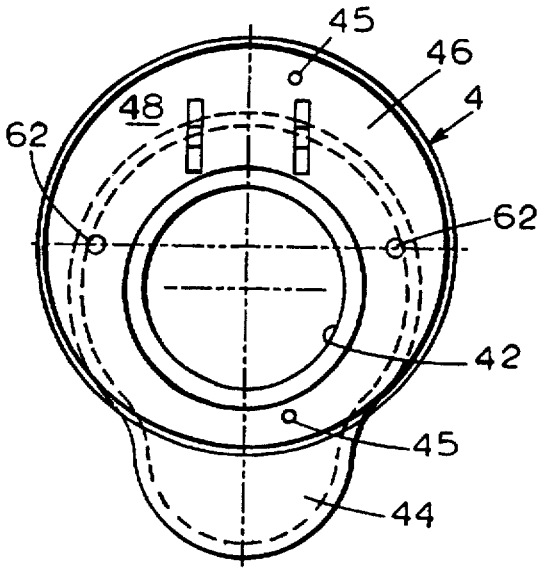
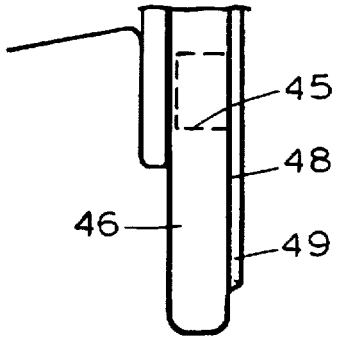
FIG. 6
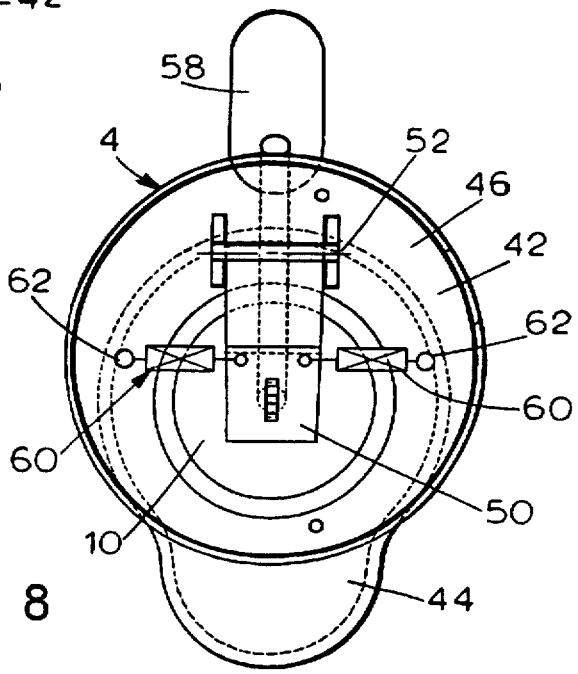
FIG. 8

SPILL-RESISTENT URINAL

TECHNICAL FIELD

The present invention relates generally to urinals, and more particularly to hand-held urinals for men who cannot use a toilet or are otherwise incapacitated.

BACKGROUND ART

Men who cannot use a toilet to urinate, or are otherwise incapacitated, typically require the use of a mobile urine collection device. These urinals are commonly designed to be hand-held by the individual user, allowing easy filling and emptying. Unfortunately, many male patients that have significant immobility, or are chronically debilitated, are unable to properly place, use, and empty such a device independently without spillage. Often, assistance is required to aid these patients, particularly with cleaning any inadvertent spills and with maintaining patient cleanliness.

The products shown in U.S. Pat. Nos. 4,665,571 and 4,309,779, for example, are prone to spillage. Tapered spouts, such as those shown in U.S. Pat. Nos. 4,091,476 and 622,631, reduce spillage when the urinal is being filled, but do little to prevent spillage if, as often occurs, a filled urinal is dropped or falls to its side before being emptied.

U.S. Pat. No. 3,928,875 discloses a disposable urine collection bag with a one-way float valve intended to prevent spillage. The product does not allow easy emptying of the urinal, and thus does not appear to be adapted to re-use.

There still remains a significant need for a re-useable, spill-resistent urinal.

SUMMARY OF THE INVENTION

The present invention is just such a device.

The urinal has a canister, a detachable spout, and two seals. One seal is easily opened or closed by the patient by activating of a trigger on the exterior of the urinal, and can be locked in an open position for extended periods of time, such as when the patient sleeps. The other seal is a dome seal with a narrow, vertically-arranged opening. The dome seal permits urine to flow easily into the canister when the urinal is being used, but resists leakage or spillage when the urinal is knocked onto its side. Thus, even if the patient leaves the manual seal in the open position, the dome seal minimizes leakage if the urinal is inadvertently knocked onto its side.

BRIEF DESCRIPTION OF THE DRAWINGS

FIG. 5 is a side view of the spout with the trigger, retainer, and seals removed;

FIG. 6 is an enlarged fragmentary view taken from FIG. 5;

FIG. 7 is an end view of the spout of FIG. 5;

FIG. 8 is an end view of the spout of FIG. 5 with the trigger and manual seal attached;

DESCRIPTION OF THE PREFERRED EMBODIMENT

Figure 1:
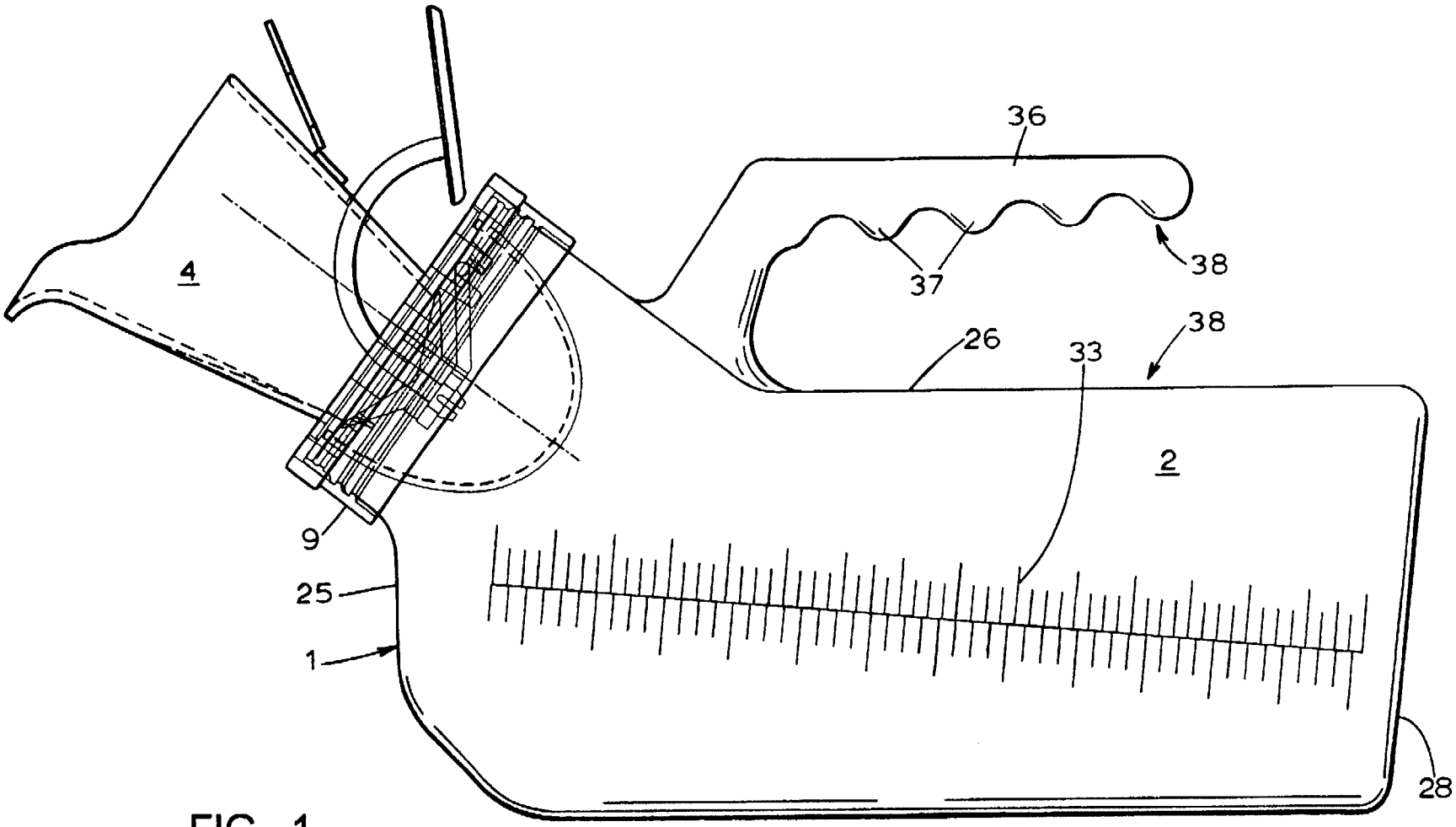
FIG. 1 is a side view of a urinal in accordance with the present invention.

FIG. 1 shows a preferred embodiment of a urinal 1 in accordance with the present invention. The urinal comprises a canister 2 with a detachable spout 4.

Figure 2:
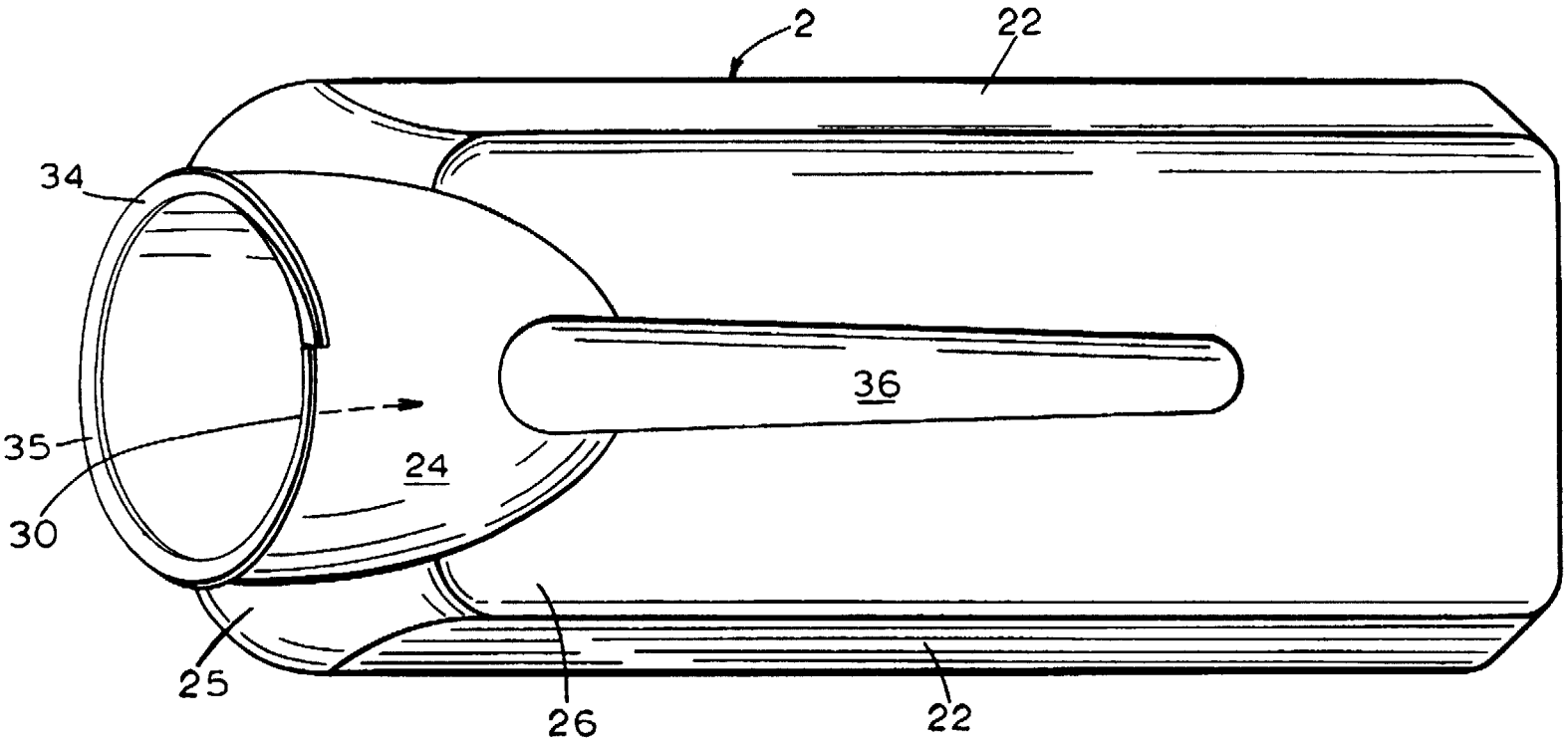
FIG. 2 is a top view of the canister of the urinal of FIG. 1.
Figure 3:
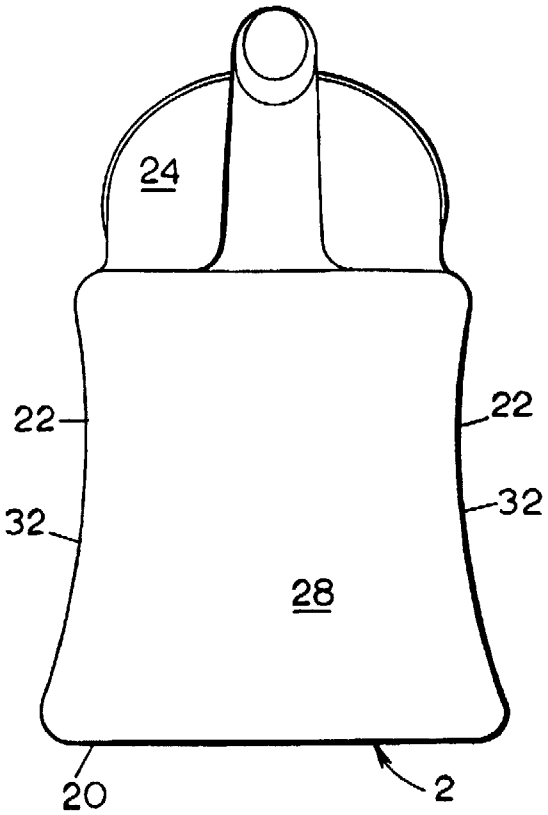
FIG. 3 is a rear view of the canister of FIG. 1.
Figure 9:
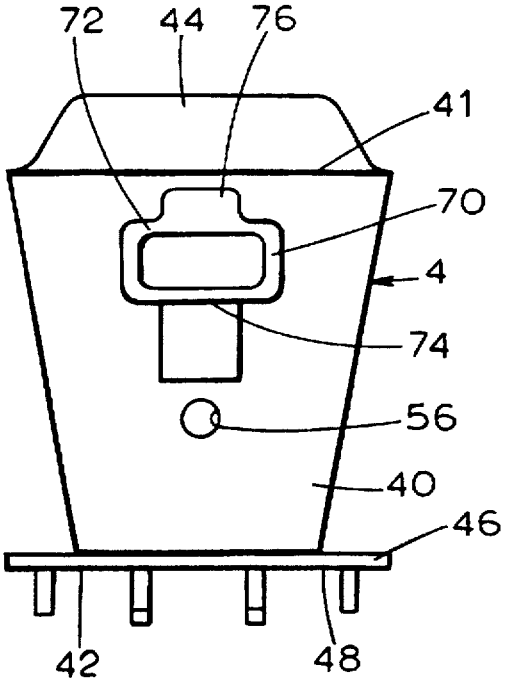
FIG. 9 is a top view of the spout of FIG. 5.
Figure 10:
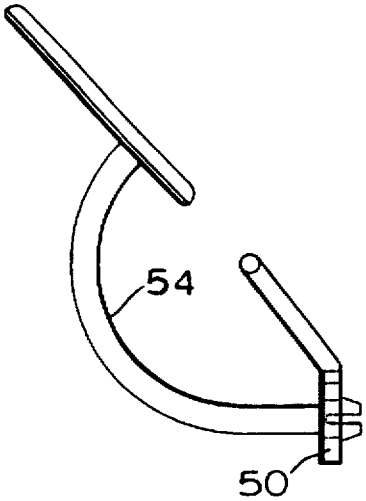
FIG. 10 is a side view of the trigger of the spout of FIG. 4.
Figure 11:
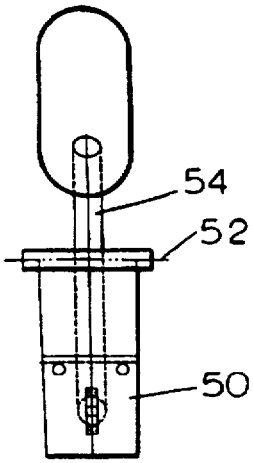
FIG. 11 is a front view of the trigger of FIG. 10.

As seen in FIGS. 2 and 3, the canister 2 is preferably made of 0.05"-thick translucent high-density polyethylene. It has a base 20 (FIG. 3) that is approximately 9" long and 3¾" wide. Side walls 22 extend upwardly from the base to a height of approximately 3¾". The canister has a neck 24 extending from a front wall 25 (FIGS. 1 and 2) and a top wall 26 at an angle of approximately 53° to the horizontal. A back wall 28 is configured to allow the canister to rest in an upright position. As is shown in FIG. 1, it is sloped at an angle of approximately 83° to the horizontal. Collectively, the walls define an interior volume 30.

As seen in FIG. 1, markings 33 on the translucent side walls 22 allow a volume of urine contained in the canister 2 to be easily measured upon standing the urinal 1 upright on the back wall 28. As seen in FIG. 3, contours 32 on the side walls, which here have a radius of approximately 6", allow the urinal to be comfortably placed between a patient's thighs while he lies in bed.

The neck 24 has a circular mouth 34 (FIG. 2) with a diameter of approximately 2¾" through which urine can flow into and out of the interior volume 30 of the canister 2. The mouth is centered approximately 4" above the base 20. A handle 36, best seen in FIG. 1, extends rearwardly from the neck, parallel to and about 2" from the top wall 26 of the canister. The handle is approximately 3½" long and ½" wide and has a series of protrusions 37 that help prevent a patient's hand from slipping from the handle. An opening 38 between the end of the handle and the top wall of the canister makes it easier for a patient to slip his hand under the handle.

The spout 4, as seen in FIGS. 4–9, is made of thermoplastic resin and has a conical section 40 that extends approximately 2½" from an opening end 41 to an internal end 42, defining a spout channel 43. The opening end has a diameter of slightly less than 2½". A lip section 44 widens the opening end for ease of use. This section of the spout can be highlighted with a pressure-sensitive fluorescent strip (not shown), which can be attached to the spout with permanent adhesive. The internal end of the conical section has a diameter of approximately 1½", and joins a circular flange 46 that has a diameter approximately equal to that of the mouth 34 of the canister 2. Preferably, however, the diameter of the flange is at least about ¼" greater than that of the opening end 41. As shown, the flange has a diameter of approximately 2¾".

Figure 4:
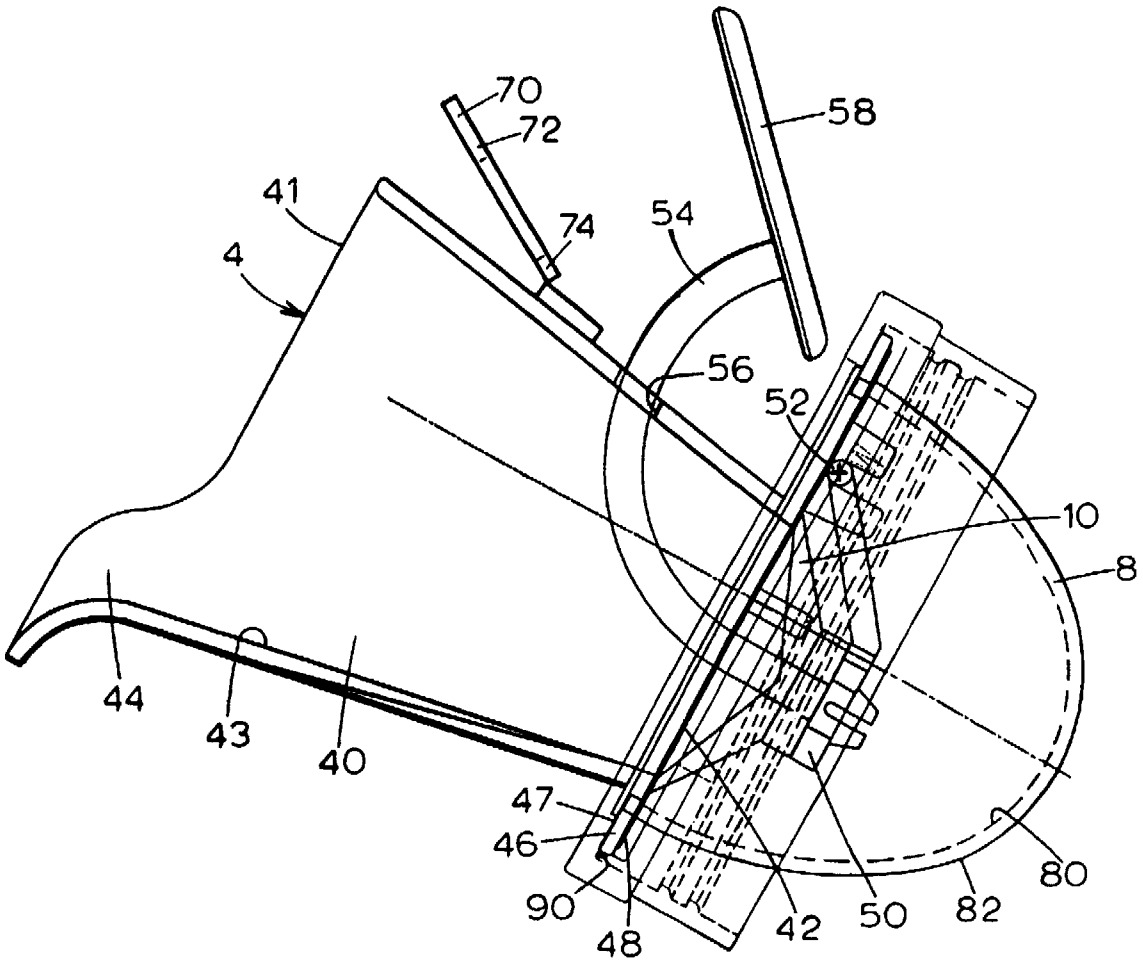
FIG. 4 is an enlarged side view of the spout of the urinal of FIG. 1.

The internal end 42 of the conical section 40 can be sealed by a manual seal 10 (FIGS. 4 and 8). The manual seal has a circular profile, and a diameter slightly greater than that of the internal end of the conical section. As shown, the diameter of the manual seal is about 1¾". The manual seal is made of thermoplastic rubber, and is fastened to a mounting plate 50 that is hinged to an inner face 48 of the flange 46 at a trigger axis 52 so that the seal may be moved between an open position (in which urine can flow past the internal end of the conical section) and a closed position (in which the seal blocks such flow). As shown, the trigger axis is about ¼" from the spout channel 43. Since the diameter of the spout channel at the internal end of the conical section is about 1¼", opening the manual seal will cause the portion of the manual seal over the lowermost portion of the internal end of the conical section to move about six times as far as the portion of the seal over the uppermost portion.

As seen in FIG. 4, a pivot arm 54 extends from the mounting plate 50 through the center of the manual seal 10 and through an aperture 56 in the conical section 40 of the spout 4 to a trigger 58 on top of the exterior of the conical section. The pivot arm allows a patient to use the trigger to manipulate the manual seal from the exterior of the urinal. For ease of use, the trigger is about 1¾" long and about ½" wide and is aligned with the trigger axis 52 and disposed at about a 45° angle with respect to the axis of the spout.

A pair of springs 60 (FIG. 8) mounted between the mounting plate 50 and a pair of spring mounting posts 62 on the inner face 48 of the flange 46 bias the manual seal 10 to its closed position. However, a retainer 70 (FIGS. 4 and 9) allows the manual seal to be locked in its open position. The retainer is mounted to the exterior of the conical section 40 of the spout 4 near the aperture 56. The retainer includes a locking arm 72 that pivots at a radius of about ¾" from a retainer axis in the form of a living spring 74. As seen in FIG. 4, the locking arm is in a rest position that is spaced at a distance from the trigger axis 52 that is greater than the distance from the trigger axis to the retainer axis, but less than the distance from the trigger axis the end of the trigger 58. Specifically, the living spring is located about 1¾" from the trigger axis 52, and the distance from the trigger axis to the end of the trigger is about 2¼". Accordingly, when the trigger is depressed, the end of the trigger comes into contact with the locking arm 72 and pushes it toward the conical section. As the locking arm moves toward the conical section, its distance from the trigger axis increases and the locking arm accordingly slides toward the end of the trigger until, finally, it loses contact with the trigger and rebounds upwards toward its rest position. Upon subsequent release of the trigger, the springs 60 (FIG. 8) push the trigger upwards until its upward movement is again restrained by the locking arm. While the force of the springs will continue to exert pressure against the locking arm, the pressure now is an upward one, which tends to move the locking arm toward (rather than away from) the trigger axis, effectively locking the trigger in a relatively depressed position, and accordingly preventing the manual seal from returning to its closed position.

A tab 76 on the locking arm 72 allows a user to easily unlock the trigger 58 to allow the manual seal 10 to return to its closed position. Pressing the tab downwardly moves the locking arm away from the trigger axis 52 (and thus toward the end of the trigger) until the trigger is disengaged from the locking arm. Once disengaged, the springs 60 pull the trigger upwardly and, simultaneously, pull the manual seal back to its closed position. Upon subsequent release of the tab, the locking arm naturally returns to its rest position.

A traditional spring biased toward the rest position could of course be substituted for the living spring shown in the drawings.

Figure 12:
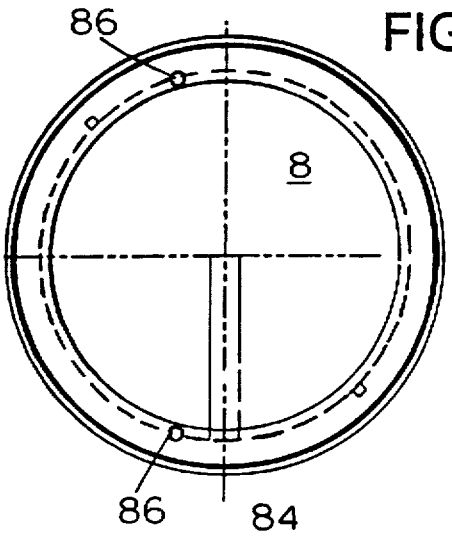
FIG. 12 is a front view of the dome seal of the spout of FIG. 4.
Figure 13:
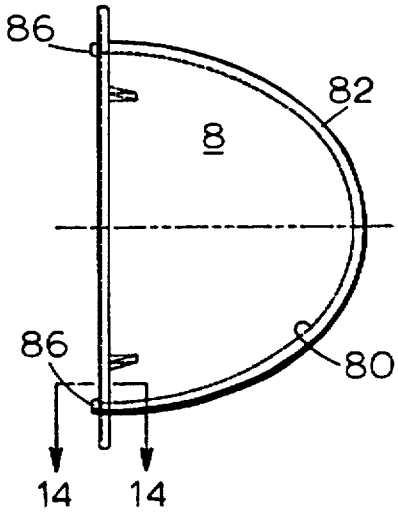
FIG. 13 is a side view of the dome seal of FIG. 12.
Figure 14:
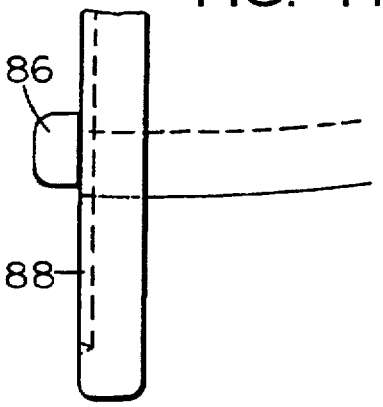
FIG. 14 is an enlarged fragmentary view taken from FIG. 13.

Leakage from the canister 2 is also minimized, even when the manual seal 10 is open, by a dome seal 8 fixed to the spout 4 and shown in FIGS. 12 and 13. As shown in FIG. 4, the dome seal is positioned against the inner face 48 of the flange 46 on the spout 4 so that a concave face 80 faces the manual seal 10 and a convex face 82 faces the interior of the canister (see FIG. 1). Lugs 86 align with recesses 45 on the flange (FIGS. 5–7), and a circular ridge 49 on the inner face of the flange (FIG. 6) fits within a circular trough 88 on the dome seal (FIG. 14). The concave face provides room for movement of the mounting place 50 and the manual seal about the trigger axis 52. As seen in FIG. 12, the dome seal is made of 1/16 to 3/32" thick ABS resin and has a vertically-arranged opening 84—about 3/16" wide and 2½" long—through which urine can pass. If the urinal is inadvertently knocked onto its side, the opening will move to a horizontal arrangement, and will help prevent the urine from spilling or splashing from the urinal unless the urine rises to a height approximately 1½" from the side wall 22 (requiring approximately 800 ml). Of course, the opening could be configured differently and still produce comparable benefits.

Figure 15:
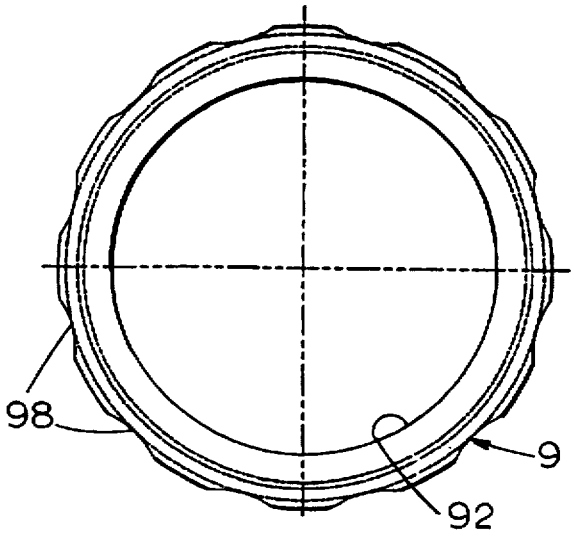
FIG. 15 is a plan view of the cap of the spout of FIG. 4.
Figure 16:
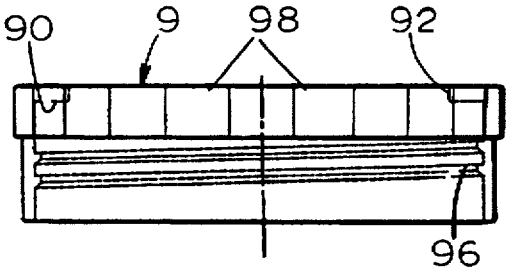
FIG. 16 is an elevational view of the cap of FIG. 15.

There are a variety of ways in which the spout 4 can be releasably secured to the canister 2. In the illustrated embodiment, the spout is secured to the canister by a collar 9, shown in FIGS. 1, 15, and 16. The collar has a central aperture 92 and is provided with internal threads 96. To secure the spout to the canister, the collar is slipped over the opening end 41 of the spout and then over the trigger 58 (see FIG. 4) so that a locking wall 90 abuts an outer face 47 of the flange 46. In order to permit this, the diameter of the central aperture 92 must be at least equal to the outside diameter of the opening end of the spout, but less than the diameter of the flange. As shown, the central aperture has a diameter of approximately 2½". The spout and collar are positioned over the mouth 34 of the canister 2, and the collar is secured to the canister by rotating the collar as the internal threads 96 (FIG. 16) engage an external thread 35 on the canister mouth (FIG. 2), securing the spout's flange between the canister mouth and the mounting face 90 of the collar. To facilitate both assembling and subsequently disassembling the urinal, the collar is provided with fingergrips 98.

This description is illustrative only, and is for the purpose of teaching those skilled in the art the best mode of carrying out the invention. Numerous modifications and alternative embodiments of the invention will be apparent to those skilled in the art, without departing from the spirit of the invention.

We claim:

1. A urinal comprising:

a canister defining an interior volume and having a mouth through which urine can flow between outside of the canister and the interior volume;

a spout adapted to be refastenably attached to the mouth to seal the mouth against the flow of urine between the interior volume and outside of the canister except through a spout channel;

a trigger on the exterior of the urinal, a seal adapted to close the spout channel upon activation of the trigger; and a locking arm for securing the seal in an open position, said locking arm arranged to surround said trigger to prevent said trigger from moving and maintain said seal in an open position.

2. The urinal of claim 1, in which:

the seal is connected to the trigger by a pivot arm that extends through an aperture in the spout.

3. The urinal of claim 1, in which:

the trigger pivots about a trigger axis and has an end spaced at a distance from the trigger axis;

the locking arm pivots about a locking arm axis that is spaced at a distance from the trigger axis that is less than the distance from the trigger axis to the end of the trigger, and greater than the difference of the distance from the trigger axis to the end of the trigger less the distance from the locking arm to the locking arm axis; and the locking arm is biased toward a rest position in which a portion of the locking arm is spaced at a distance from the trigger axis that is greater than the distance from the trigger axis to the locking arm axis but less than the distance from the trigger axis to the end of the trigger.

4. A urinal comprising:

a canister defining an interior volume and having a mouth through which urine can flow between outside of the canister and the interior volume;

a spout adapted to be refastenably attached to the mouth and having a flange to seal the mouth against the flow of urine between the interior volume and outside of the canister except through a spout channel;

a dome seal disposed between the spout channel and the canister, having a vertically-arranged opening; and a collar that connects the spout to the canister and traps the dome seal in a fixed position between the mouth of the canister and the flange on the spout.

5. The urinal of claim 4, in which:

the dome seal has a convex face facing the interior volume of the canister; and the opening in the dome seal is no more than about ¼" wide.

6. The urinal of claim 4, in which:

the collar has a central aperture that slides over an opening end of the spout.

7. A urinal comprising:

a canister defining an interior volume and having a mouth through which urine can flow between outside of the canister and the interior volume;

a spout attached to the mouth to seal the mouth against the flow of urine between the interior volume and outside of the canister except through a spout channel;

a trigger on the exterior of the urinal adapted to close the spout channel upon activation of the trigger; and a second seal disposed on the spout, having a vertically-arranged elongate opening that is secured in a fixed position; and means for releasably trapping the second seal between the mouth of the canister and the spout.

8. The urinal of claim 7, in which:

the urinal further comprises a retainer with a locking arm for securing the manual seal in an open position.

9. The urinal of claim 7, in which:

the second seal has a concave face facing the manual seal, and the manual seal opens toward the second seal.

* * * * *